US006298804B1

(12) United States Patent
Kamen

(10) Patent No.: US 6,298,804 B1
(45) **Date of Patent: *Oct. 9, 2001**

(54) BOOK MARK FOR DUAL COLUMN PAGE

(76) Inventor: Jack M. Kamen, 8782 N. Cricket Tree La., Indianapolis, IN (US) 46260

( * ) Notice: Subject to any disclaimer, the term of this patent is extended or adjusted under 35 U.S.C. 154(b) by 0 days.

This patent is subject to a terminal disclaimer.

(21) Appl. No.: 09/476,839

(22) Filed: Jan. 3, 2000

Related U.S. Application Data

(63) Continuation of application No. 09/136,536, filed on Aug. 19, 1998, now Pat. No. 6,021,735, which is a continuation-in-part of application No. 08/742,884, filed on Nov. 1, 1996, now Pat. No. 5,803,012.

(51) Int. Cl.[7] ..... B42D 9/00
(52) U.S. Cl. ..... 116/234; 116/235; 116/240
(58) Field of Search ..... 116/234, 235, 116/236, 237, 238, 239, 240; 281/42

(56) References Cited

U.S. PATENT DOCUMENTS

| | | | |
|---|---|---|---|
| D. 32,731 | 5/1900 | Conger . | |
| D. 333,317 | 2/1993 | Jimenez | D19/32 |
| 446,857 | 2/1891 | Fiske | 116/235 |
| 1,420,265 | 6/1922 | Kieckhefer | 116/235 |
| 1,966,340 | 7/1934 | Forbringer et al. | 116/235 |
| 2,475,698 | 7/1949 | Croker | 116/235 X |
| 2,543,182 | 2/1951 | Lang . | |
| 2,953,115 | 9/1960 | Haskins | 116/235 |
| 3,266,456 | 8/1966 | O'Reilly | 281/42 X |
| 4,358,012 | 11/1982 | Marsala et al. | 281/42 X |
| 4,901,665 | 2/1990 | Carlin | 116/235 |
| 5,081,948 | 1/1992 | Walsh | 116/235 |
| 5,311,835 | 5/1994 | Knowles | 116/235 |
| 5,325,811 | 7/1994 | Miroyan | 116/235 |
| 5,515,809 | 5/1996 | Weinberg | 116/235 |
| 5,803,012 | 9/1998 | Kamen | 116/235 |

*Primary Examiner*—Helen Kwok
*Assistant Examiner*—Willie Morris Worth
(74) *Attorney, Agent, or Firm*—Bose McKinney & Evans LLP

(57) ABSTRACT

A book mark is provided for marking a selected line and column of a book. The book mark includes a flat elongated member, first and second page indicators and a column indicator. Each of the first and second page indicators includes an indicia positioned on the flat elongated member. The column indicator indicates a specific column in a book having dual column pages.

32 Claims, 4 Drawing Sheets

BOOK MARK FOR DUAL COLUMN PAGE

This application is a continuation of U.S. application Ser. No. 09/136.536, filed Aug. 19, 1998 (now U.S. Pat. No. 6.021,735, issued Feb. 8, 2000), which is a continuation-in-part of U.S. application Ser. No. 08/742,884, filed Nov. 1, 1996 (now U.S. Pat. No. 5,803,012, issued Sep. 8, 1998), which are expressly incorporated by reference herein.

BACKGROUND AND SUMMARY OF THE INVENTION

The present invention relates to a bookmark that a reader uses to mark a particular location in a book. More particularly, the present invention relates to a bookmark that marks a particular page, line, and column in the book where the reader wishes to resume reading.

Readers use books as a source of entertainment and education and often find it necessary to stop reading a book before they have finished reading the book. It is convenient to mark a location in the book where the reader stops reading to reduce the time needed to find the location in the book when the reader wishes to resume reading later.

According to the present invention, a bookmark is provided for use in a book having a height and a plurality of pages. Each of the plurality of pages has a plurality of lines and columns. When the book is open, a right-hand page and a left-hand page face a reader of the book. The bookmark includes a flat elongated member, first and second page indicators, a marker, and a column indicator. The flat elongated member includes a first end, a second end spaced apart from the first end, a middle region situated between the first and second ends, a first side, and a second side facing away from the first side. The first and second page indicators include indicia positioned on the flat elongated member. The marker marks a selected line of the book. The marker is fixed relative to and spaced apart from the first and second page indicators. The marker is situated in the middle region of the flat elongated member. The column indicator is positioned on the flat elongated member.

Additional features and of the invention will become apparent to those skilled in the art upon consideration of the following detailed description of preferred embodiments exemplifying the best mode of carrying out the invention as presently perceived.

BRIEF DESCRIPTION OF THE DRAWING

The detailed description particularly refers to the accompanying figures in which:

FIG. 2 is a perspective view showing the bookmark placed in the book to mark a specific line of text on the inner column of the right-hand page;

FIG. 3 is a perspective view showing the bookmark placed in the book to mark a specific line of text on the outer column of the right-hand page;

FIG. 4 is a perspective view showing the bookmark placed in the book to mark a specific line of text on the inner column of the left-hand page;

FIG. 5 is a perspective view showing the bookmark placed in the book to mark a specific line of text on the outer column of the left-hand page;

DETAILED DESCRIPTION OF THE DRAWINGS

Figure 1:
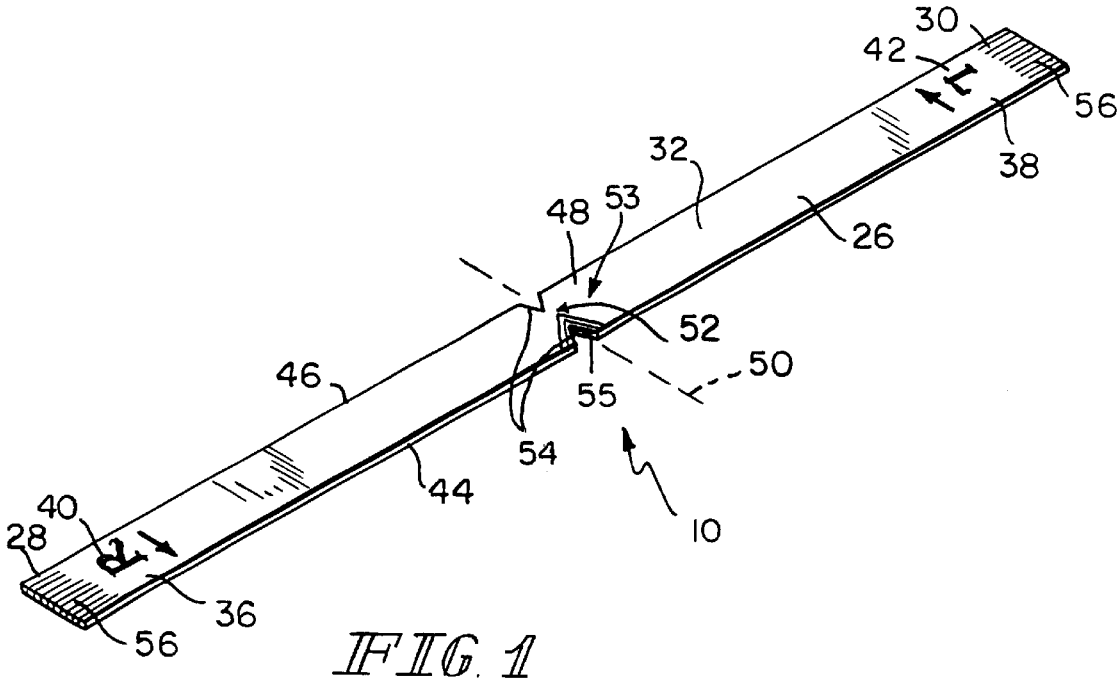
FIG. 1 is a perspective view of a dual column bookmark according to the present invention showing the bookmark including a flat elongated member, a page indicator that indicates a specific page in the book, a column indicator that indicates a specific column on the page, and a line marker that marks a particular line of text, the page indicator being "R" and "L" indicia and arrow indicia, the line market being a pair of notches formed in the flat elongated member, and the column indicator being column indicia around one of the notches.

A bookmark 10 in accordance with the present invention is shown in FIG. 1. The bookmark 10 includes a flat elongated member 26 having a first end 28, a second end 30 spaced apart from the first end 28, a first side 32, and a second side 34 which is facing away from the first side 32 as shown, for example, in FIGS. 1 and 7. The bookmark 10 further includes a first page indicator 36 on the first end 28 and second page indicator 38 on the second end 30. As shown in FIG. 1, the first page indicator 36 of bookmark 10 includes an "R→" indicia 40 and the second page indicator 38 of bookmark 10 includes an "L←" indicia 42.

The flat elongated member 26 further includes spaced-apart first and second edges 44, 46 and a middle region 48 located between the first and second ends 28, 30. The middle region 48 includes a center line 50 that intersects the first edge 44 and the second edge 46 equidistant from the first and second ends 28, 30.

The bookmark 10 further includes a line marker 52 and a column indicator 53. The line marker 52 is located along center line 50 and on first and second sides 32, 34. The line marker 52 marks a particular line of text. In the illustrated embodiment, the line marker 52 includes a pair of arrowhead-shaped notches 54 that interrupt and are located on the first and second edges 44, 46 and are appended to the flat elongated member 26. In the illustrated embodiment, the column indicator 53 includes column indicia 55 surrounding a notch 54 of line marker 52. In alternative embodiments, any type of indicia or member may be used as a column indicator such as a dot (not shown). In alternative embodiments, the column indicator may be spaced apart from the line marker.

As FIG. 1 shows, the line marker 52 is fixed relative to the first end 28 and the second end 30 in the middle region 48. Because the line marker 52 is fixed to the middle region 48, the bookmark 10 is a one-piece design.

FIG. 1 shows the first side 32 of bookmark 10. As shown in FIGS. 2–5, the second side 34 of bookmark 10 is identical to first side of bookmark 10.

FIGS. 2–5 show the bookmark 10 lying within an open book 12. The book 12 includes a top end 14, a bottom end 16, a spine 15, a side edge 17 extending between the top and bottom ends 14, 16, and a plurality of pages 18. When book 12 is open, a left-hand page 20 and a right-hand page 22 face a reader of the book 12. Each of the left-hand page 20 and right-hand page 22 include a particular line 24 of text 24 and inner and outer columns 19, 21.

A reader indicates the last page read by placing an appropriate end 28, 30 of the bookmark 10 at the top end 14 of the open book 12. The reader selects the appropriate end 28, 30 of the bookmark 10 by noting whether the reader stopped reading on the left-hand page 20 or the right-hand page 22. The reader selects the end 28 with the "R→" indicia 40 when the reader should resume reading on the right-hand page 22 or the end 30 with the "L←" indicia 42 when the reader should resume reading on the left-hand page 20. The reader then places the selected end 28, 30 at the top end 14 of the book 12.

Figure 2:
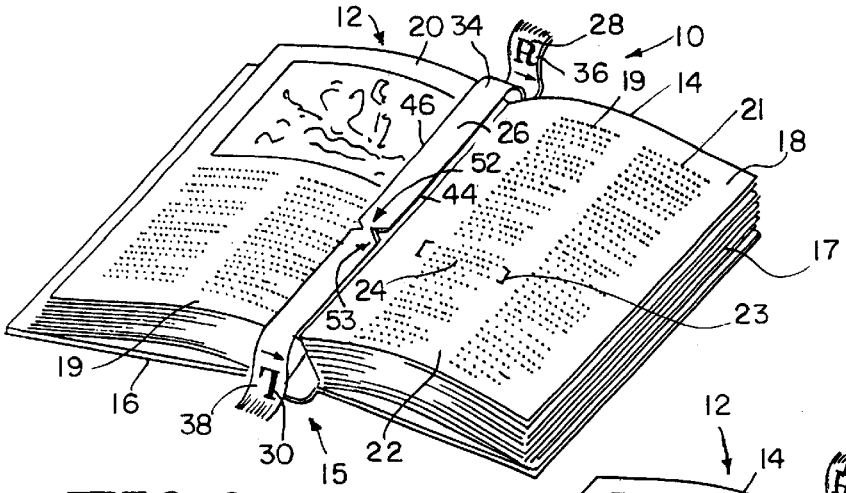
FIGS. 2–5 are perspective views of the dual column bookmark of FIG. 1 lying in an open book having right and left-hand pages and inner and outer columns on each page.

When the reader resumes reading, she or he references the indicia 40, 42 on the end 28, 30 of the bookmark 10 near the top end 14 of the book 12. This indicia 40, 42 notifies the reader as to which page 20, 22 to resume reading. As shown in FIG. 2, the reader placed the end 28 with the "R→" indicia 40 at the top end 14 of the book 12 when she or he stopped reading the book 12. Therefore, the reader should resume reading on the right-hand page 22 as indicated by the "R→" indicia 40. By referencing the indicia 40, 42 near the top end 14 of the book 12, the reader saved time by not having to scan both pages 20, 22 of the book 12 to determine where to resume reading.

A reader indicates a specific line 24 on which the reader wishes to resume reading by moving the entire bookmark 10 and aligning the line marker 52 with the specific line 24 to be marked. When the reader resumes reading the book 12, the reader scans the first edge 44 and/or the second edge 46 for the line marker 52. Once the line marker 52 is located, the reader resumes reading at the marked line 24.

A reader indicates a specific column 19, 21 on which the reader wishes to resume reading by placing column indicator 53 within book 12 so that column indicator 53 faces toward spine 15 of the book 12 or toward the side edge 17 of the book 12. Column indicator 53 may be placed facing toward spine 15 or side edge 17 by placing one of first and second sides 32, 34 against book 12. If the column indicator 53 faces toward the spine 15 of book 12, then the reader knows to resume reading inner column 19 of book 12. If the column indicator 53 faces toward side edge 17 of book 12, then the reader knows to resume reading outer- column 21 of book 12.

The bookmark 10 may be oriented within book 12 in many different orientations based on the book text location 23 where a reader is to resume reading. The book text location 25 varies based on the right or left hand page 20, 22, inner or outer column 19, 21, and line 24 of book 12 where the reader is to resume reading.

Figure 3:
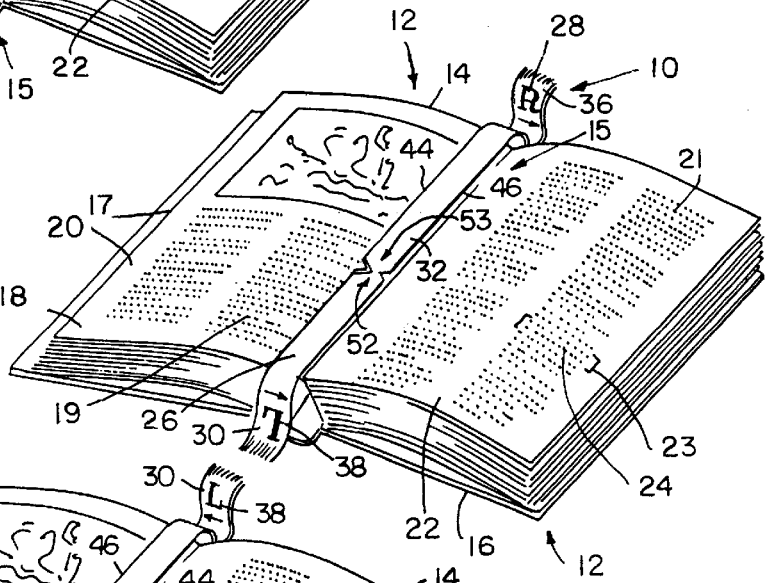
Figure 4:
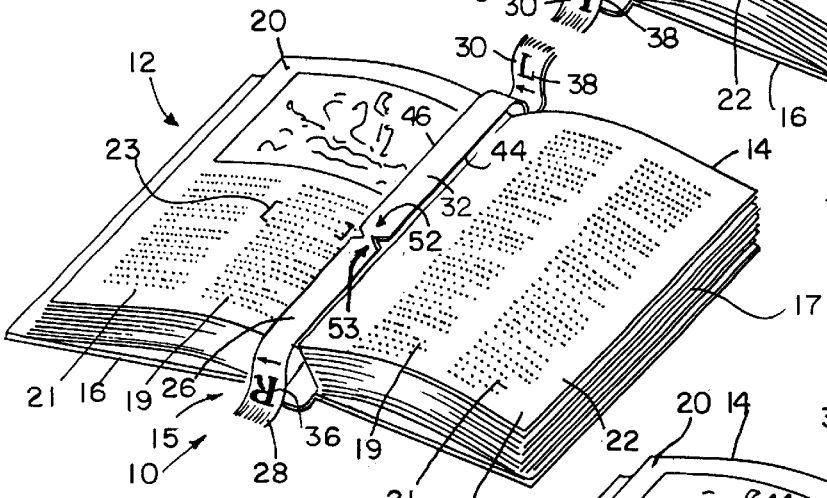
Figure 5:
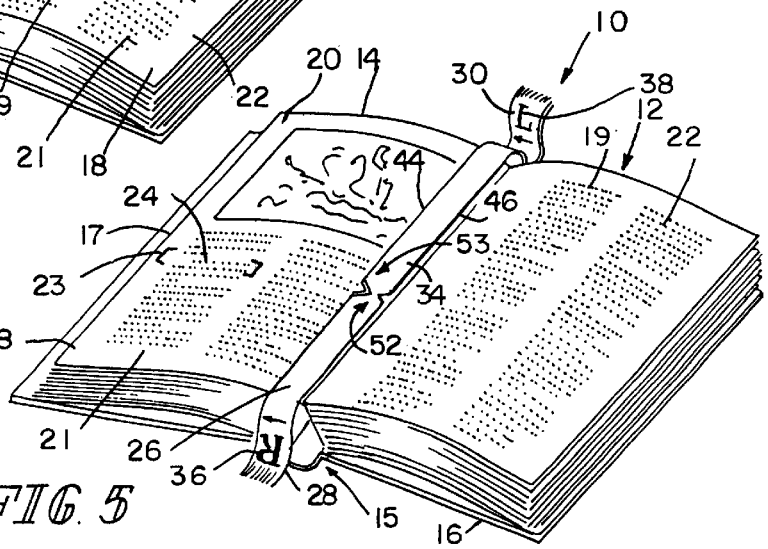

Four representative orientations of bookmark 10 are shown in FIGS. 2–5. In FIG. 2, bookmark 10 is oriented within book 12 to mark a book text location 25 at line 24 of inner column 19 of right-hand page 22. In FIG. 2, bookmark 10 is lying on left-hand page 20 of book 22. In FIG. 3, bookmark 10 is oriented within book 12 to mark a book text location 25 at a line 24 of outer column 21 of right-hand page 22. In FIG. 4, bookmark 10 is oriented within book 12 to mark a book text location 25 at a line 24 of inner column 19 of left-hand page 20. In FIG. 5, bookmark 10 is oriented within book 12 to mark a book text location 25 at a line 24 of outer column 21 of left-hand page 20.

When book 12 is reopened, the bookmark 10 will identify the proper book text location 25 whether bookmark 10 is lying on left-hand page 20 or right-hand page 22 of book 12. The proper book text location 25 is identified because the column indicator 53 of the first and second sides 32, 34 of bookmark 10 are identical and thus each side 32, 34 will properly identify the correct page 20, 22, column 19, 21, and line 24 to resume reading.

Figure 6:
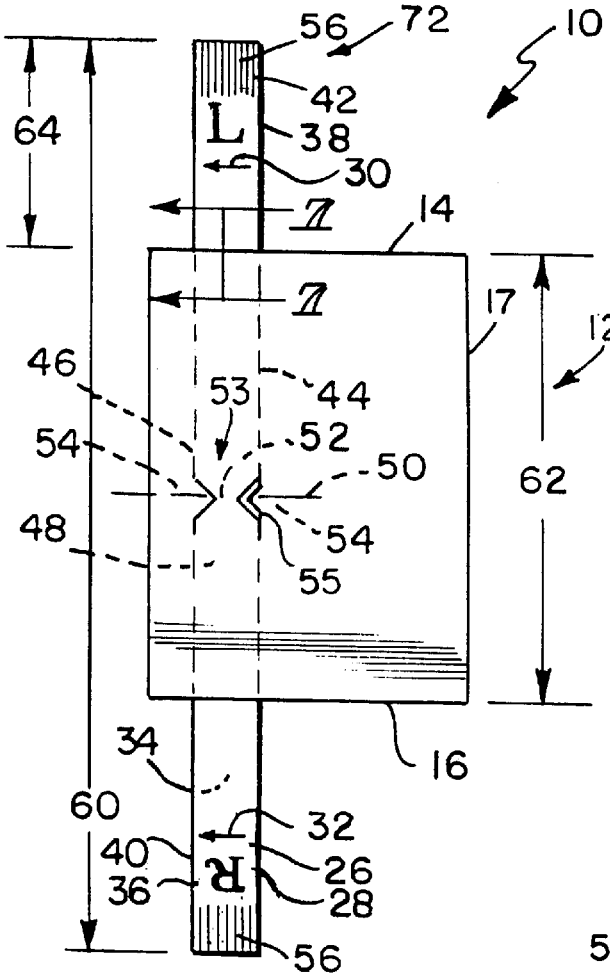
FIG. 6 is a top plan view of the dual column bookmark of FIG. 1 showing the bookmark lying within a closed book, the bookmark having a length, and the book having a book height that is less than the length of the bookmark.

The bookmark 10 shown in FIG. 6 has a length 60 and the book 12 has a height 62 that is less than the bookmark length 60. The greater length 60 of bookmark 10 permits one bookmark 10 to be used with many size books 12.

Furthermore, the bookmark 10 has an excess length 64 that extends beyond the top end 14 of the book 12 as shown in FIG. 6. The excess length 64 of the bookmark 10 allows the reader to roughly approximate the location of the line marker 52 and column indicator 53 within the book 12 by noting the amount of excess length 64 of the bookmark 10. This allows the reader to reduce the time needed to scan along the first edge 44 and/or second edge 46 of bookmark 10 to find the line marker 52 and column indicator 53 because the reader knows in advance of opening the book 12 approximately where the line marker 52 and column indicator 53 are located.

When bookmark 10 is located within a closed book 12, exterior compressive and tensile forces 58 act upon bookmark 10. Such forces 58 can be created by contact with objects, gravity, changes in momentum, jarring or tilting the book, and from other sources. The left-hand page 20 of the book 12 has a left-hand page surface 68 and the right-hand page 29 has a right-hand page surface 70.

In preferred embodiments, the first and second sides 32, 34 of the bookmark 10 have surfaces with high coefficients of friction relative to paper. A surface having a high coefficient of friction creates greater resistive frictional force to act against an applied force 58 than a low coefficient of friction surface creates. When the first and second sides 32, 34 come into contact with the left-hand and right-hand page surfaces 68, 70, respectively, friction is created. This friction helps resist the potential movement of bookmark 10 created by the exterior compressive or tensile forces 58 applied to the bookmark 10.

In preferred embodiments, the bookmark 10 also includes a decorative fringe 56 located on the first and second ends 28, 30 of the flat elongated member 26 as shown, for example, in FIGS. 1–6. The decorative fringe 56 makes the first and second ends 28, 30 more pliable. This increased pliability decreases the likelihood that the forces 58 will push the bookmark 10 away from position marking book text location 25.

As mentioned above, the bookmark 10 is made of a pliable material. A pliable material is both flexible and compliant. Because the bookmark 10 is pliable, exposed ends of the bookmark 10 situated outside of the book 12 may be folded over and placed between two pages in the book 12 so that the book 12 may be easily placed on a shelf without the bookmark 10 interfering with the placement of the book 12 on the shelf.

Pliable members cannot support compressive loads or forces 58. Because bookmark 10 is pliable, common exterior compressive forces 58 applied to the exposed portion 72 of the bookmark 10 will not move the bookmark 10 and cause the marked line 24 to be lost. Furthermore, because the bookmark 10 is made of a pliable material, it is more convenient to store or transport than a more rigid member. A pliable member can be manipulated into many forms. For example, the bookmark 10 can be folded up to fit into a pocket or a purse for easy transportation or storage. The bookmark's pliable nature also resists snapping and breaking that can occur with more rigid elongated bodies.

Figure 7:
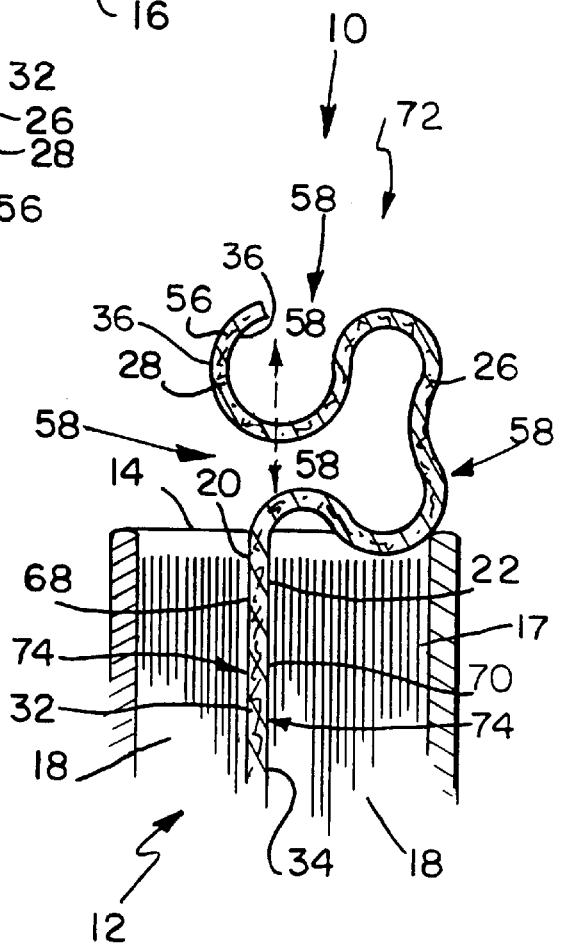
FIG. 7 is a sectional view taken along line 7—7 of FIG. 6 showing the bookmark in contact with the closed book and the pliable nature of the flat elongated member.

Also, the bookmark 10 is made of a compressible material. A compressible material deforms when compressive forces 74 are applied to it. As shown in FIG. 7, when the book 12 is closed with the bookmark 10 within it, internal compressive forces 74 are applied to the bookmark 10 which cause the bookmark 10 to deform. This internal compressive force 74 and the deformation allows the bookmark 10 to rest more securely within the closed book 12.

Suede leather is an example of a material that is pliable, has surfaces with high coefficients of friction, and is compressible. Other suitable materials also exist with these properties that could be used for the bookmark 10.

Figure 8:
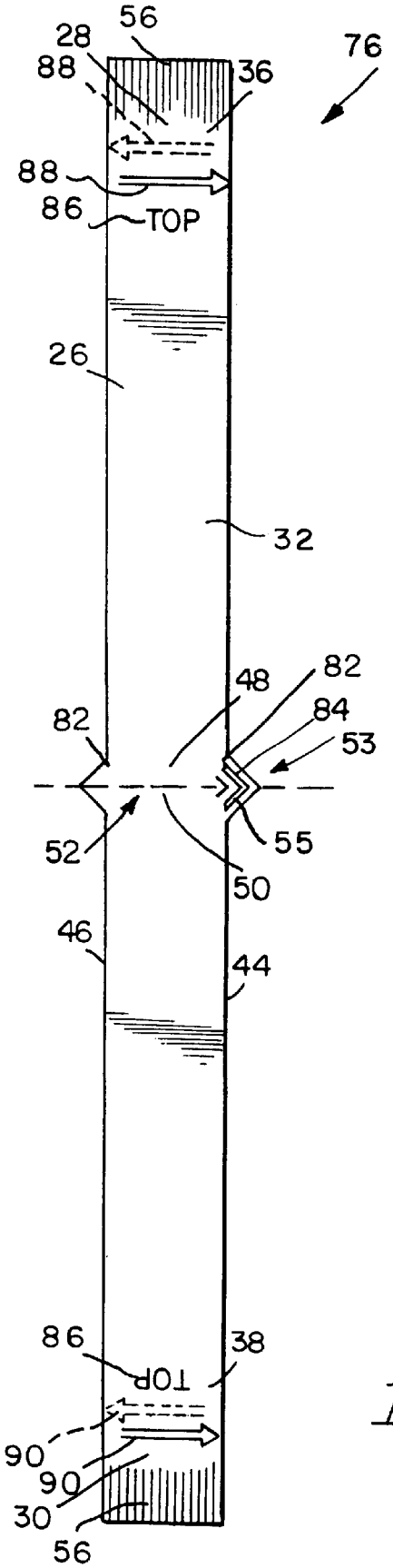
FIG. 8 is a top plan view of another embodiment of the present invention showing a bookmark including a flat elongated member, a page indicator being arrows and "Top" indicia, a pair of line markers being a pair of detents connected to the flat elongated member, and a column indicator including column indicia positioned within one of the detents.

Another bookmark 76 according to the present invention is shown in FIG. 8. This embodiment of the bookmark 76 includes the line marker 52 having detents 82 connected to the flat elongated member 26. The column indicator 53 includes column indicia 84 within a detent 82.

The first and second page indicators 36, 38 include a "TOP" indicia 86 located on the first and second ends 28, 30 of the flat elongated member 26. Furthermore, the first page indicator 36 includes a right-pointing arrow indicia 88 located on the first end 28 and the second page indicator 38 includes a the left-pointing (when FIG. 8 is viewed wrong-side up) arrow indicia 90 located on the second end 30. The first and second page indicators 36, 38 also includes the "TOP" indicia 86 located on the second side 34 at both ends 28, 30, the right-pointing arrow indicia 88 located on the first end 28 of the second side 34, and the left-pointing arrow indicia 90 located on the second end 30 of the second side 34.

In alternative embodiments of the present invention, the arrow indicia may be used without the TOP indicia. In alternative embodiments of the present invention, other indicia may be used to indicate the last page, line, and column read.

The "TOP" indicia 86 notifies the bookmark user to place the corresponding indicator 36, 38 near the top end 14 of the book 12. It also reminds the reader upon resuming reading the book 12 that the corresponding page indicator 36, 38 is located near the top end 14. This helps to eliminate potential confusion for a reader that has forgotten how to use the bookmark over a period of time.

When the right-pointing arrow indicia 88 is located near the top end 14 of the book 12, the reader is notified to continue reading on the right-hand page 22. Conversely, when the left-pointing arrow indicia 90 is located near the top end 14, the reader is notified to continue reading on the left-hand page 20.

Although this invention has been described in detail with reference to certain embodiments, variations and modifications exist within the scope and spirit of the invention as described and as defined in the following claims.

What is claimed is:

1. A bookmark for use in a book including a height and a plurality of pages, each of the plurality of pages have a plurality of lines, an inner column, and an outer column, and when the book is open a right-hand page and a left-hand page face a reader of the book, the bookmark comprising a member having a first side and a second side facing away from the first side, each of the first and second sides including a right portion and a left portion, first and second page indicators, each of said first and second page indicators including indicia positioned on the member to indicate at least one of the right-hand page and the left-hand page as an indicated page, a first column indicator positioned substantially on the right portion of the first side to indicate at least one of the inner and outer columns of the indicated page, and a second column indicator positioned substantially on the left portion of the second side to indicate at least one of the inner and outer columns of the indicated page.

2. The bookmark of claim 1, wherein the first and second column indicators are non-alphabetic.

3. The bookmark of claim 1, wherein the member has a first edge and a second edge spaced apart from the first edge and the first and second column indicators are equidistant from the first edge.

4. The bookmark of claim 1, wherein the member has a first edge and a second edge spaced apart from the first edge and the first column indicator extends to the first edge.

5. The bookmark of claim 1, wherein the member has a first end and a second end spaced apart from the first end and the first and second column indicators are positioned equidistant from the first end.

6. The bookmark of claim 1, further comprising a marker situated on the member to indicate a line on an indicated column.

7. The bookmark of claim 1, wherein the first column is the only column indicator on the first side and the second column indicator is the only column indicator on the second side.

8. A bookmark for use in a book including a height and a plurality of pages, each of the plurality of pages have a plurality of lines and columns and when the book is open a right-hand page and a left-hand page face a reader of the book, the bookmark comprising a member having a first side, a second side facing away from the first side, a first edge, and a second edge spaced apart from the first edge, first and second page indicators, each of said first and second page indicators including indicia positioned on the member, a first column indicator positioned on the first side of the member at a first position relative to the first edge, and a second column indicator positioned on the second side of the member at a second position relative to the first edge that is substantially the same as the first position.

9. The bookmark of claim 8, wherein the member has a middle region and the first and second column indicators are positioned in the middle region of the member.

10. The bookmark of claim 8, wherein the first and second Column indicators are non-alphabetic.

11. The bookmark of claim 8, wherein the first column indicator extends to the first edge.

12. The bookmark of claim 8, wherein the member has a first end and a second end spaced apart from the first end and the first and second column indicators are positioned equidistant from the first end.

13. The bookmark of claim 8, further comprising a marker situated on the member to indicate a line on an indicated column.

14. A bookmark for use in a book including a height and a plurality of pages, each of the plurality of pages have a plurality of lines and columns and when the book is open a right-hand page and a left-hand page face a reader of the book, the bookmark comprising a member having a first side, a second side facing away from the first side, a first edge, and a second edge spaced apart from the first edge, first and second page indicators, each of said first and second page indicators including indicia positioned on the member, and first and second column indicators positioned relative to the first edge to indicate a column as an indicated column, the first column indicator including a first indicia positioned on the first side of the member and the second column indicator including a second indicia positioned on second side of the member that is identical to the first indicia.

15. The bookmark of claim 14, wherein the first and second column indicators are non-alphabetic.

16. The bookmark of claim 14, wherein the first and second column indicators are equidistant from the first edge.

17. The bookmark of claim 14, wherein the first column indicator extends to the first edge.

18. The bookmark of claim 14, wherein the member has a first end and a second end spaced apart from the first end and the first and second column indicators are positioned equidistant from the first end.

19. The bookmark of claim 14, further comprising a marker situated on the member to indicate a line on an indicated column.

20. A bookmark for use in a book including a height and a plurality of pages, each of the plurality of pages have a plurality of lines and columns and when the book is open a right-hand page and a left-hand page face a reader of the book, the bookmark comprising a member having a first side, a second side facing away from the first side, a first edge, and a second edge spaced apart from the first edge, first and second page indicators, each of said first and second page indicators including indicia positioned on the member, and a non-alphabetic column indicator positioned on the member relative to the first edge to indicate one of the columns as an indicated column.

21. The bookmark of claim 20, further comprising another non-textual column indicator, wherein the column indicators are equidistant from the first edge.

22. The bookmark of claim 20, wherein the column indicator extends to the first edge.

23. The bookmark of claim 20, further comprising another non-textual column indicator, wherein the member has a first end and a second end spaced apart from the first end and the column indicators are positioned equidistant from the first end.

24. The bookmark of claim 20, further comprising a marker situated on the member to indicate a line on an indicated column.

25. A bookmark for use in a book including a height, a plurality of pages, and a spine, each of the plurality of pages have a plurality of lines, an inner column positioned adjacent to the spine, and an outer column, and when the book is open a right-hand page and a left-hand page face a reader of the book, the bookmark comprising a member having a first side, a second side facing away from the first side, a first edge, and a second edge spaced apart from the first edge, first and second page indicators, each of said first and second page indicators including indicia positioned on the member to indicate at least one of the right-hand page and the left-hand page, and means for indicating at least one of the inner and outer columns by selecting one of the first and second edges as a selected edge and positioning the selected edge adjacent to the spine of the book.

26. The bookmark of claim 25, wherein the indicating means includes non-alphabetic first and second column indicators positioned on the member.

27. The bookmark of claim 25, wherein the member has a first edge and a second edge spaced apart from the first edge, the indicating means includes a first column indicator positioned on the first side of the member and a second column indicator positioned on the second side of the member, and the first and second column indicators are equidistant from the first edge of the member.

28. The bookmark of claim 25, wherein the member has a first edge and a second edge spaced apart from the first edge and the indicating means includes a column indicator positioned on the first side of the member that extends to the first edge of the member.

29. The bookmark of claim 25, wherein the member has a first end and a second end spaced apart from the first end, the indicating means includes a first column indicator positioned on the first side of the member and a second column indicator positioned on the second side of the member, and the first and second column indicators are positioned equidistant from the first end of the member.

30. The bookmark of claim 25, further comprising a marker situated on the member to indicate a line on an indicated column.

31. A method for marking a page and column of a book having a plurality of pages, and a spine, each of the plurality of pages have a plurality of lines, an inner column positioned adjacent to the spine, and an outer column, and when the book is open a right-hand page and a left-hand page face a reader of the book, the method comprising the steps of providing a bookmark having first and second page indicators, a first edge, a second edge spaced apart from the first edge, and a column indicator positioned adjacent the first edge, positioning at least one of the first and second page indicators relative to the book to indicate at least one of the fight-hand and left-hand pages as an indicated page, selecting at least one of the first and second edges as a selected edge and the other edge as an unselected edge, and positioning the selected edge closer to the spine than the unselected edge to indicate at least one of the inner and outer columns on the indicated page.

32. The method of claim 31, wherein the providing step further includes providing a bookmark having a marker to indicate a line and further comprising the step of positioning the marker relative to a line to indicate a marked line.

* * * * *